US006067364A

United States Patent [19]

Brinkley et al.

[11] Patent Number: 6,067,364

[45] Date of Patent: May 23, 2000

[54] MECHANICAL ACOUSTIC CROSSOVER NETWORK AND TRANSDUCER THEREFOR

[75] Inventors: Gerald E. Brinkley, West Palm Beach; John M. McKee, Hillsboro Beach, both of Fla.

[73] Assignee: Motorola, Inc., Schaumburg, Ill.

[21] Appl. No.: 08/989,918

[22] Filed: Dec. 12, 1997

[51] Int. Cl.[7] ..... H04R 25/00

[52] U.S. Cl. ..... 381/396; 381/151; 381/370; 381/414; 340/825.46; 340/311.1

[58] Field of Search ..... 381/396, 151, 381/412, 413, 414, 370, 374, 380; 340/825.46, 311.1, 825.44, 388.5, 407.1

[56] References Cited

U.S. PATENT DOCUMENTS 5,327,120 7/1994 McKee et al. .
5,524,061 6/1996 Mooney et al. .
5,546,069 8/1996 Holden et al. ..... 340/407.1

*Primary Examiner*—Curtis A. Kuntz
*Assistant Examiner*—Phylesha L. Dabney
*Attorney, Agent, or Firm*—Philip P. Macnak

[57] ABSTRACT

A taut armature reciprocating impulse transducer (100) which typically provides a non-linear hardening spring response is adapted to provide a non-linear softening spring response by the addition of magnetic damping elements (106). Two or more taut armature reciprocating impulse transducers (100) can be utilized to produce a mechanical acoustic crossover network (700) which operates to produce a wide frequency response when at least one of the two taut armature reciprocating impulse transducers (100) is adapted to provide a non-linear softening spring response. The mechanical acoustic crossover network (700) allows multiple taut armature reciprocating impulse transducers (100) to be operated together from a signal input. When the mechanical acoustic crossover network (700) is enclosed in a housing (812), the mechanical acoustic crossover network (700) can be operated as a headphone to deliver an audio output.

21 Claims, 5 Drawing Sheets

500

600

700

800

800

SECTION A–A

1000

1000

MECHANICAL ACOUSTIC CROSSOVER NETWORK AND TRANSDUCER THEREFOR

FIELD OF THE INVENTION

This invention relates in general to electromagnetic transducers, and more specifically to a mechanical acoustic crossover network utilizing non-linear hardening spring and softening spring taut armature reciprocating impulse transducers.

BACKGROUND OF THE INVENTION

Speaker systems have utilized low frequency (bass), mid-range frequency, and high frequency (tweeter) speakers to provide a wide operating frequency range required to reproduce audio program material having a very wide frequency range. Such speaker systems have often relied on cross-over networks to separate audio program material into low frequency, mid frequency and high frequency components for optimum reproduction by the bass, mid-range, and high frequency speakers. Such cross-over networks are often complex and add to the expense of the speaker system.

Headphones are often relied upon to provide listening capability for portable radio frequency receivers. Piezoelectric transducers have often been used in such headphones to provide the frequency response necessary to present the audio program material. As a result, there is no provision to handle separately the low frequency, mid frequency and high frequency components of the audio program material, which often leads to a less than optimum wide frequency response from the headphones.

What is therefore needed is a transducer which can provide a low frequency response, and which can be coupled to other transducers which have mid range and high frequency responses without the need for crossover networks to provide a wide operating frequency range.

DESCRIPTION OF THE PREFERRED EMBODIMENT

Figure 1:
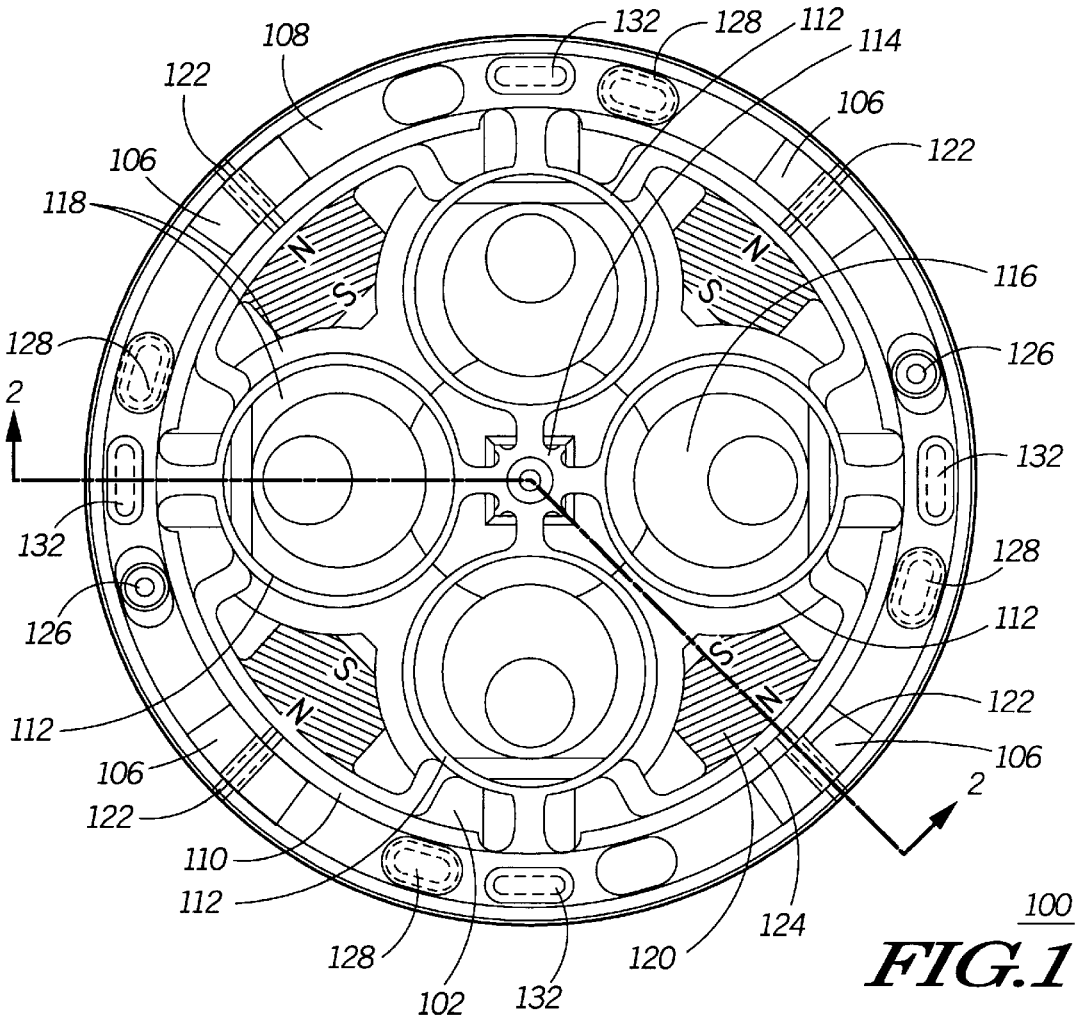
FIG. 1 is an orthogonal top view of a taut armature reciprocating inertial transducer suitable for use in the mechanical acoustic crossover network in accordance with the present invention, FIG. 2, a cross-sectional view taken along the line 2—2 of the taut armature reciprocating inertial transducer of FIG. 1.

FIG. 1 is an orthogonal top view of a taut armature reciprocating inertial transducer 100 which provides a non-linear softening spring response for use in a mechanical acoustic crossover network in accordance with the present invention. Shown in FIG. 1 is a coil form 102 which functions as a chassis which encapsulates an electromagnetic coil 104 (FIG. 2) which functions as an electromagnetic driver to effect an alternating electromagnetic field in response to an input signal to produce motion to a motional mass 116, as will be described in detail below. The coil form 102 is manufactured using conventional double shot injection molding techniques using a plastic material, such as a thirty-percent glass-filled liquid crystal polymer which fully encloses the coil 104 except for terminals 126 which provide electrical connection to the electromagnetic coil 104. It will be appreciated that other plastic materials can be utilized for the coil form 102, as well as other configurations for the coil form 102, such as a bobbin supporting the coil, and an open wound coil impregnated with an epoxy material to provide structural rigidity. The coil form 102 establishes two planar perimeter seating surfaces 130 (FIG. 2) about a planar perimeter region 108 on which two planar suspension members 110 are supported, and further includes eight contiguously molded bosses 132 which are used to orient and affix the planar suspension members 110 to the coil form 102 using a staking process, such as provided using heat or ultrasonics. The upper and lower planar suspension members 110 are substantially parallel to each other and are used to stabilize the motion of the magnetic motional mass as described in U.S. Pat. No. 5,327,120 issued Jul. 5, 1994 to McKee et al., entitled "Stabilized Electromagnetic Resonant Armature Tactile Vibrator" which is assigned to the assignee of the present invention.

Figure 3:
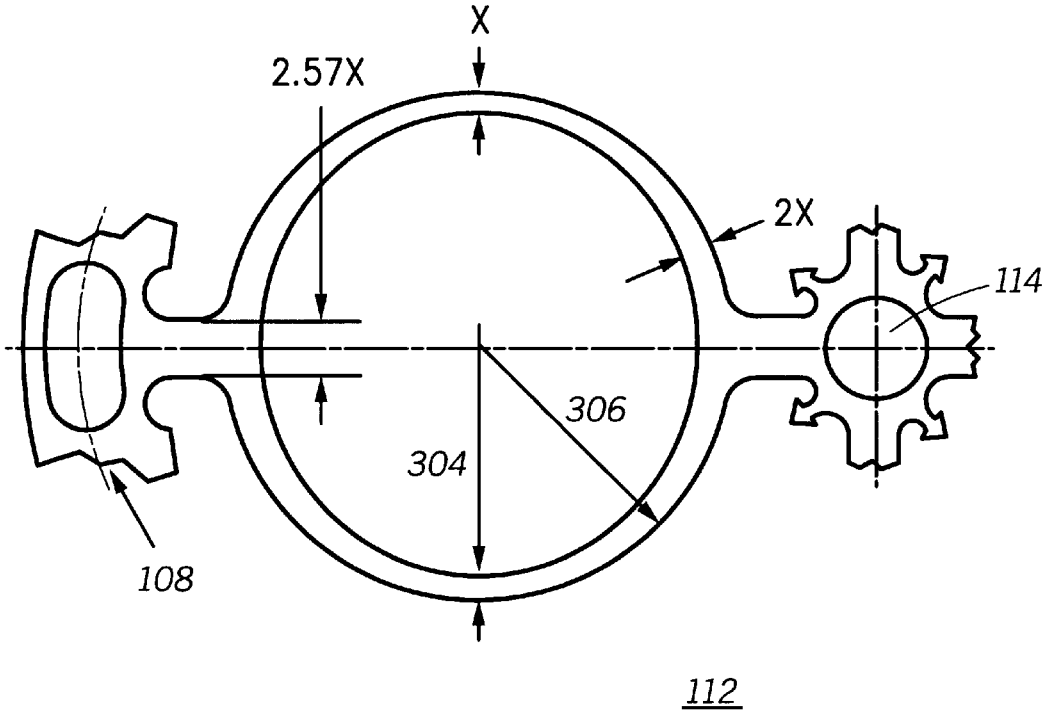
FIG. 3 is a top view of an independent planar non-linear spring member which is utilized in the taut armature reciprocating inertial transducer of FIG. 1.

Each of the upper and lower planar suspension members 110 comprises four independent planar non-linear spring members 112, as will be described below, which are arranged regularly around a planar central region 114 which is used for positioning and fastening the motional mass 116 to the two planar suspension members 110 also using preferably a staking process. The planar non-linear spring members 112 are preferably defined by the pair of spring members as having a circular outer perimeter and an elliptical inner perimeter such as shown in FIG. 3 below, and as shown and described in U.S. Pat. No. 5,524,061 which issued Jun. 4, 1996 to Mooney et al., entitled "Dual Mode Transducer" which is assigned to the assignee of the present invention. The planar suspension members 110 are preferably manufactured from a sheet metal, such as Sandvik™ 7C27M02 stainless martensitic chromium steel alloyed with molybdenum, or a 17-7 PH heat treated CH900 precipitation-hardened stainless steel. It will be appreciated that other antimagnetic materials can be utilized as well. The planar suspension members are formed preferably by a chemical etching, or machining technique. The motional mass 116 is manufactured using conventional die casting techniques using a Zamak 3 zinc die-cast alloy, although it will be appreciated that other materials can be utilized as well.

The arrangement of the parts of the taut armature reciprocating inertial transducer 100 is such that the motional mass 116 can be displaced upwards and downwards in a direction normal to the planes of the two planar suspension members 110, the displacement being restricted by a restoring force provided by the independent planar non-linear spring members 112 in response to the displacement. The motional mass 116 is formed such that there are shaped channels 118 for allowing the motional mass 116 to extend through and around the independent planar non-linear spring members 112 during extreme excursions of the motional mass 116, thereby providing a greater mass to volume ratio for the taut armature reciprocating inertial transducer 100 than would be possible without the shaped channels 118. The motional mass 116 includes, by way of example, four radially polarized permanent magnets 120 which are arranged regularly around the perimeter of the motional mass 116. The four radially polarized permanent magnets 120 are magnetically coupled to the electromagnetic coil 104 such that the electromagnetic field generated by the electromagnetic coil 104 alternately moves the motional mass 116, the movement of the motional mass 116 being transformed through the planar non-linear spring members 112 and the chassis, or coil form 102 into motional energy which is generated in a direction parallel to the axis 142 of the motional mass 116, and when coupled to a soundboard produces acoustical energy as will be described below.

The four radially polarized permanent magnets 120 are manufactured using Samarium Cobalt having a preferable Maximum Energy Product of 28-33 and having a N-S radial orientation to produce a coercive force of 8K-11K Oersteds, although it will be appreciated that other magnetic materials such as Alnico™ can be utilized as well with a corresponding performance change with regard to the amount of acoustic energy being generated.

An additional detail shown in FIG. 1 comprises four radial projections 122 projecting in a direction normal to each surface (top and bottom) of the coil form 102 for compressively engaging with the planar perimeter region 108 of the top planar suspension member 110. The projections 122 pre-load the planar perimeter region 108 after the planar suspension member 110 is attached to the surface of the coil form 102 using bosses 132 located on either side of each of the projections 122. The bosses 132 are staked using heat or ultrasonic energy to secure the planar suspension members 110 to the planar perimeter region 108 of the coil form 102. The purpose of pre-loading is for preventing audible (high frequency) parasitic vibrations during operation of the taut armature reciprocating impulse transducer 100.

Figure 2:
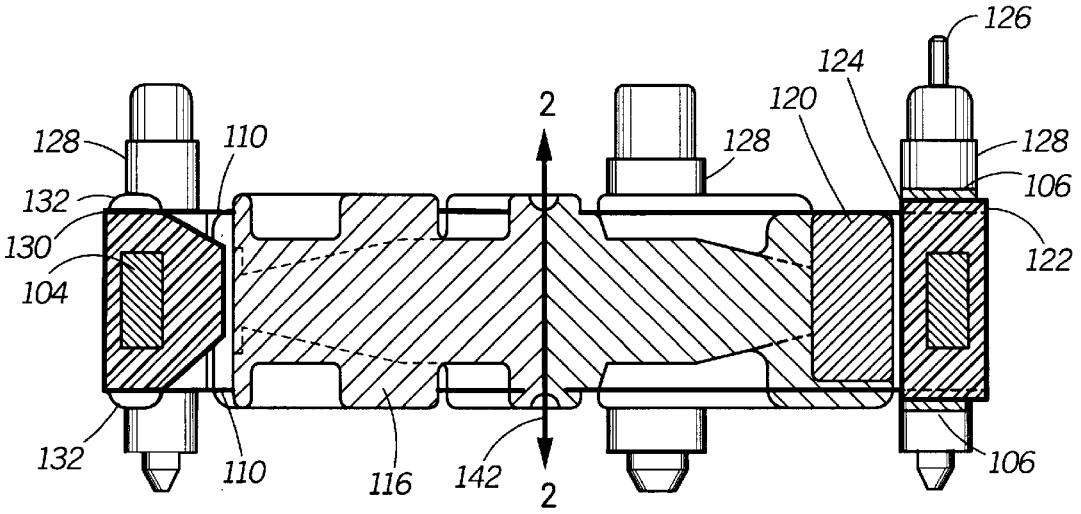

With reference to FIG. 2, a cross-sectional view taken along the line 2—2 of the taut armature reciprocating inertial transducer of FIG. 1 shows an air gap 124. The air gap 124 surrounds the motional mass 116 (partially shown), thus allowing the motional mass 116 to move in a direction normal to the planes of the two planar suspension members 110. The taut armature reciprocating impulse transducer 100 can be utilized as is or enclosed in a housing made of an antimagnetic material such a copper or beryllium copper, or a non-magnetic material such as an injection molded thermoplastic material, by means of projections 128 for staking a housing (not shown) to coil form 102.

The taut armature reciprocating inertial transducer 100 as described above provides a non-linear hardening spring response such as described in Mooney et al., U.S. Pat. No. 5,524,061 and provides an operating frequency range above the fundamental operating frequency of the device. The taut armature reciprocating inertial transducer 100 as described above which provides a non-linear hardening spring response can be adapted to provide a non-linear softening spring response, as will be described below, in those instances where an operating frequency range is desirable below the fundamental operating frequency of the device, such as required to provide a very low frequency or bass response.

The non-linear hardening spring response characteristic of the taut armature reciprocating inertial transducer described above can be altered to provide a non-linear softening spring response by the addition of magnetic damping elements 106 (four of eight of which are used are shown in FIG. 1) which are positioned adjacent to each of the radially polarized permanent magnets 120. The magnetic damping elements 106 are preferably formed from a sheet metal which will not easily magnetize, such as soft iron. The magnetic damping elements 106 are preferably formed to conform to the geometry of the faces of the four radially polarized permanent magnets 120, and further formed to clear the projections 122, thereby allowing the magnetic damping elements 106 to be affixed, using an adhesive, to the surface of the planar non-linear spring members 112 which are affixed to the top and bottom surfaces of the coil 102.

The non-linear hardening spring response typically provided by the taut armature reciprocating inertial transducer 100 is controlled by the planar non-linear spring members 112 and establishes the fundamental operating frequency of the taut armature reciprocating inertial transducer 100. With the additional of the magnetic damping elements 106, a non-linear softening spring response is obtained, the magnitude of which can be adjusted by varying the thickness of the magnetic damping elements 106, and also by adjusting the proximity of the magnetic damping elements 106 to the four radially polarized permanent magnets 120, such as by reducing the air gap 124 between the four radially polarized permanent magnets 120 and the faces of the magnetizing damping elements 106. The response of the taut armature reciprocating inertial transducer 100 which provides a non-linear softening spring response is shown below in FIG. 6.

With reference to FIG. 3, there is shown a top view of the planar non-linear spring member 112, described above, which can be utilized in taut armature reciprocating inertial transducer 100 in accordance with the present invention. The planar non-linear spring members 112 are defined by a pair of spring members having maximum opposing widths tapering to minimum opposing widths at midpoints of the pair of springs, the maximum opposing widths are coupled to the central planar region and to the planar perimeter region. The planar non-linear spring member 112 has a planar, substantially circular spring member having in one embodiment a circular inner diameter 304 and an elliptical outer diameter 306, as shown in FIG. 3; and in another embodiment an elliptical inner diameter 304 and a circular outer diameter 306. Other spring member geometry's which taper the width of the spring member to provide the non-linear hardening spring response can be utilized as well.

Figure 4:
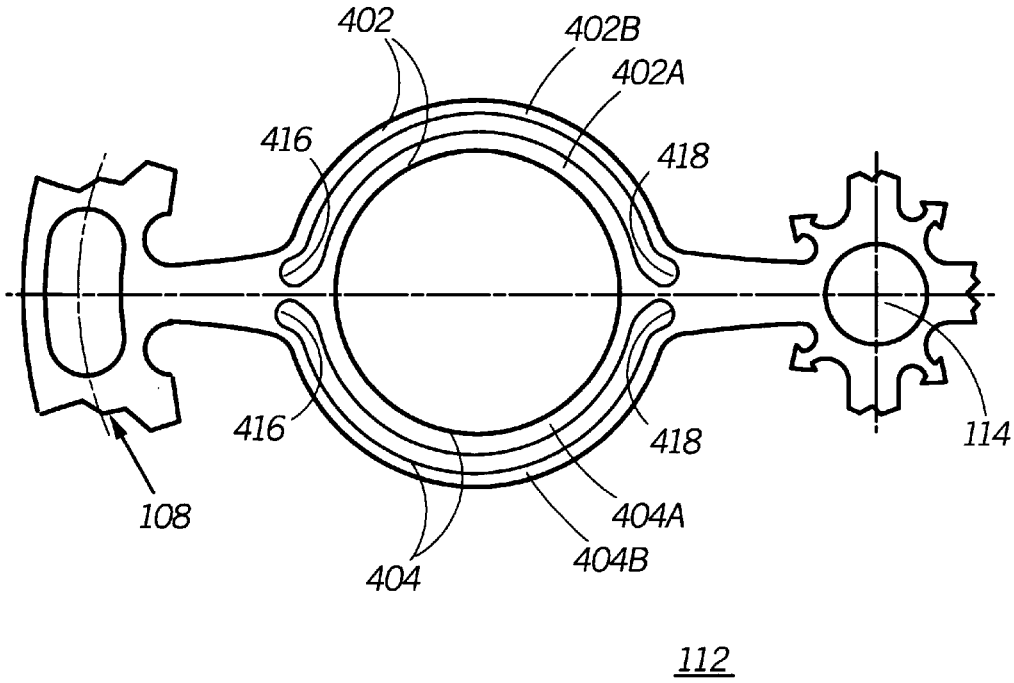
FIG. 4 is a top view of a planar non-linear compound spring member which is utilized in the taut armature reciprocating inertial transducer of FIG. 1.

Referring to FIG. 4 which is a top elevational view of a planar non-linear spring member 112 which can also be utilized in the taut armature reciprocating impulse transducer 100. The planar non-linear spring member 112 comprises a pair of juxtaposed planar compound beams 402 and 404 which are connected symmetrically about a contiguous planar central region 114. The juxtaposed planar compound beams 402 and 404 are also connected to a planar perimeter region 108. Each of the juxtaposed planar compound beams 402 and 404 comprises respectively two independent concentric arcuate beams, inner beams 402A and 404A, and outer beams 402B and 404B, each having the same, or substantially constant, spring rates (K). The substantially constant spring rates are achieved by reducing the width of the inner beam relative to the width of the outer beam over a functional beam length of the beam as described in U.S. Pat. No. 5,546,069 issued Aug. 13, 1996 to Holden et al., entitled "Taut Armature Reciprocating Impulse Transducer" which is assigned to the assignee of the present invention and which is incorporated by reference herein.

The juxtaposed planar compound beams 402 and 404 are connected to the planar central region 114 and to the planar perimeter region 108 by filleted regions, or a fillet 416 and a fillet 418 which have a radius which is greater than the medial width of the outer beams 402B and 404B. The fillet 416 and fillet 418 significantly reduce the stress generated at the connection of the juxtaposed planar compound beams 402 and 404 to the planar central region 114 and to the planar perimeter region 108.

Figure 5:
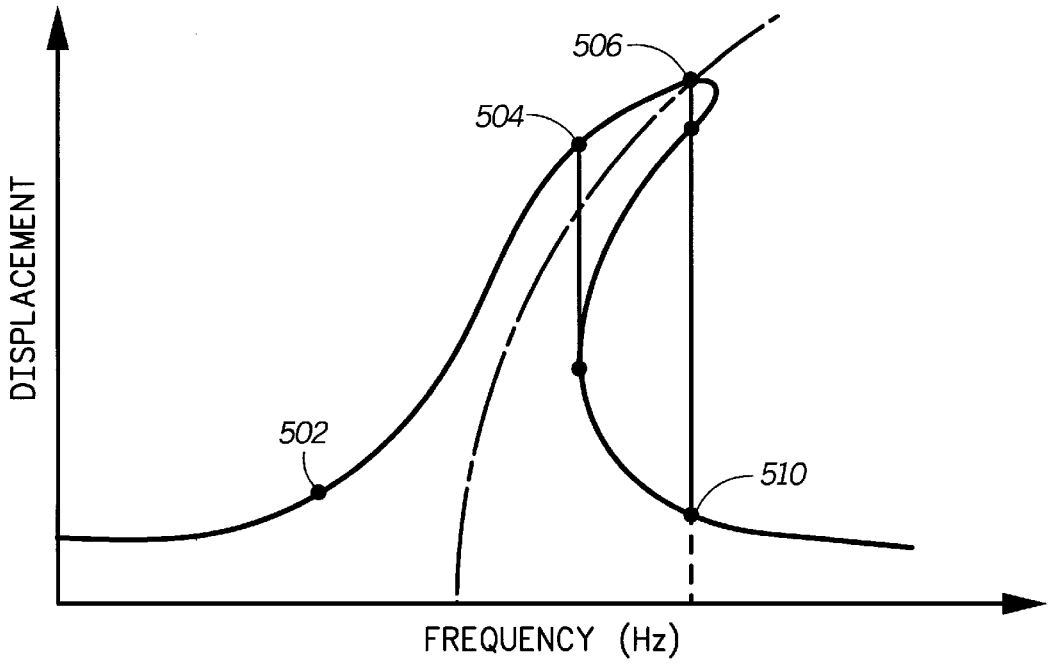
FIG. 5 is a graph depicting the impulse output as a function of frequency for the taut armature reciprocating inertial transducer of FIG. 1 utilizing a non-linear, hardening spring type resonant system when driven as a transducer.

FIG. 5 is a graph 500 depicting the impulse output response as a function of input frequency for the taut armature reciprocating impulse transducer which provides a non-linear, hardening spring response. The taut armature reciprocating impulse transducer can be driven by a swept input frequency, operating between a first driving frequency to provide a lower impulse output 502 and a second driving frequency to provide an upper impulse output 504 to provide a tactile alerting device, as described in U.S. Pat. No. 5,546,069 to Holden et al., and U.S. Pat. No. 5,524,061 to Mooney et al. Continuing to sweep the input frequency to a higher driving frequency will produce an impulse output 506 which is unstable resulting in a jump to impulse output 510 will result.

The taut armature reciprocating impulse transducer 100 can also be operated as an acoustic transducer to reproduce, as an example a musical presentation, in which instance only those impulse responses above operating state 510 are desirable. However, it will be appreciated that any instantaneous impulse responses which are generated during the reproduction of the musical presentation which causes operation of the taut armature reciprocating impulse transducer between operating states 502 and 504 would be largely imperceptible to a listener, and would be perceived as a tactile rather than acoustic response.

Figure 6:
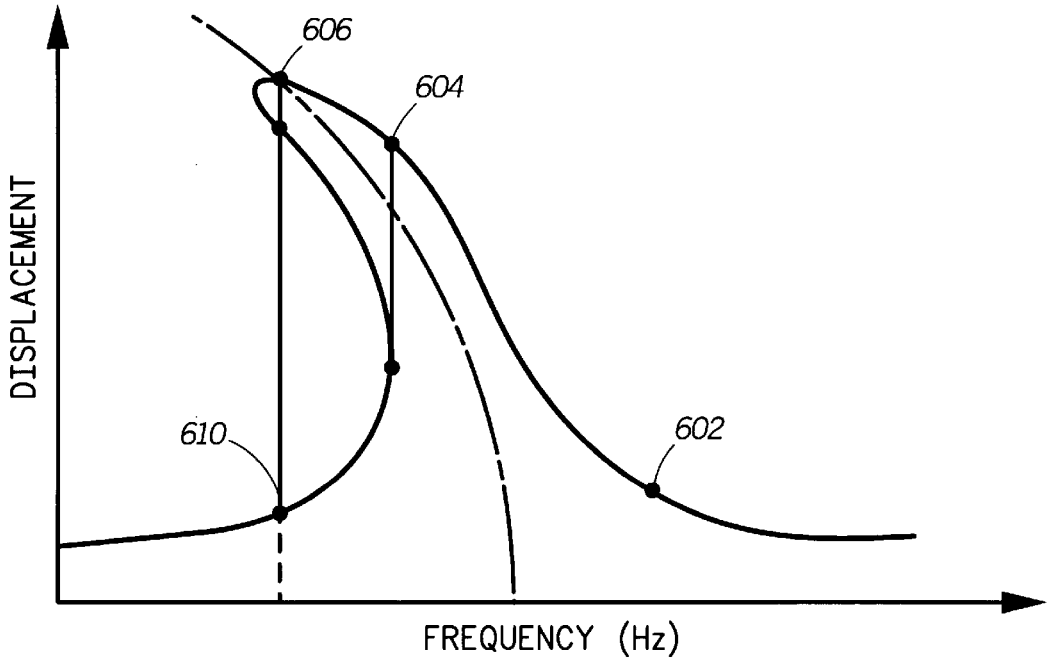
FIG. 6 is a graph depicting the impulse output as a function of frequency for the taut armature reciprocating inertial transducer of FIG. 1 utilizing a non-linear, softening spring type resonant system when driven as a transducer.

FIG. 6 is a graph 600 depicting the impulse output response as a function of input frequency for the taut armature reciprocating impulse transducer 100 which provides a non-linear, softening spring response, such as described above. Unlike the taut armature reciprocating impulse transducer which provides a non-linear, hardening spring response, a taut armature reciprocating impulse transducer which provides a non-linear softening spring response produces an increasing impulse response as the swept input frequency is reduced between operating states 602 and 604. In the present invention, the non-linear softening spring response is due to the interaction of the four radially polarized permanent magnets 120 and the magnetizing damping elements 106, as described above. As the displacement of the motional mass 116 is increased, the level of interaction between the four radially polarized permanent magnets 120 and the magnetizing damping elements 106 becomes increased as well, until an impulse output 606 is reached which is unstable, at which point impulse output 610 will result.

Figure 7:
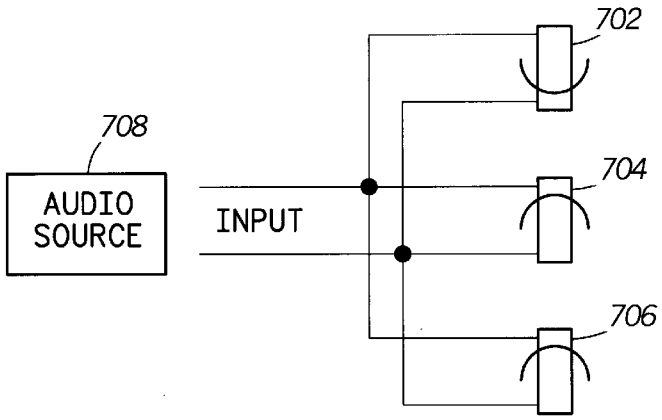
FIGS. 7 and 8 are orthographic views of the mechanical acoustic crossover network in accordance with the present invention.

FIG. 7 is an electrical block diagram of a mechanical acoustic crossover network 700 in accordance with the present invention. The mechanical acoustic crossover network 700 preferably includes three taut armature reciprocating impulse transducers which have been selected for frequency response characteristics so as to provide a bass, mid range and high frequency responses to musical programming, such as provided by an audio source 708, The bass, mid range and high frequency responses are combined in a manner to be described below to produce a wide frequency range (high fidelity) transducer. It will be appreciated that an acceptable wide frequency range transducer can be obtained through the use of two taut armature reciprocating impulse transducers which have been selected for frequency response characteristics so as to provide low and high frequency responses to the musical programming, as will also become apparent from the description provided below.

The characteristics of the taut armature reciprocating impulse transducers utilized in the mechanical acoustic crossover network 700 are provided in Table 1 below:

TABLE I

| Ref No. | Response | Function | Armature Type |
|---|---|---|---|
| 702 | softening | bass | simple non-linear softening spring |
| 704 | hardening | mid range | simple non-linear hardening spring |
| 706 | hardening | tweeter | compound non-linear hardening spring or multiple simple non-linear hardening springs |

The taut armature reciprocating impulse transducer 702 provides a softening spring response and utilizes upper and lower planar suspension members 110 having simple planar non-linear springs 112, as shown in FIG. 3, with magnetic damping elements 106 to provide a bass frequency response to musical programming. A taut armature reciprocating impulse transducer 704 which provides a hardening spring response also utilizes upper and lower planar suspension members 110 having simple planar non-linear springs 112 as shown in FIG. 3 to provide a mid-range frequency response to musical programming. A taut armature reciprocating impulse transducer 706 which provides a hardening spring response utilizes upper and lower planar suspension members 110 having compound planar non-linear springs as shown in FIG. 4 to provide a high frequency response to musical programming.

While the taut armature reciprocating impulse transducer 100 shows the use of only a single upper planar suspension member and a single lower planar suspension member, a taut armature reciprocating impulse transducer 706 can also utilize multiple upper and lower planar suspension members 110, such as two upper and two lower planar suspension members, each having simple planar non-linear springs 112 as shown in FIG. 3 to provide the high frequency response to musical programming. The mechanical acoustic crossover network 700 can be connected to the output of an audio amplifier, and does not require the use of electrical crossover networks as required when bass, midrange and tweeter speakers are connected in a loudspeaker system.

Figure 8:
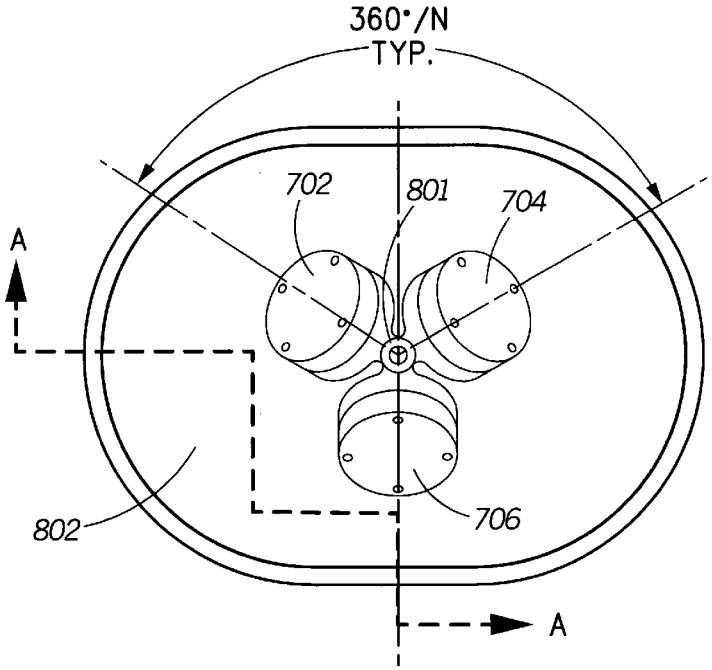
Figure 9:
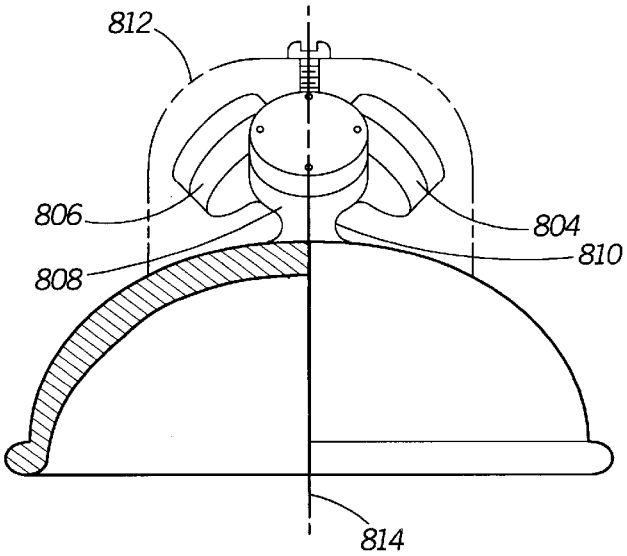
FIG. 9 is an electrical block diagram of a mechanical acoustic crossover network in accordance with the present invention.

FIGS. 8 and 9 are orthographic views 800 of the mechanical acoustic crossover network 700 in accordance with the present invention. The mechanical acoustic crossover network 700 includes a soundboard 802 which can be formed to couple to the ear of a user, such as provided by a headphone, as shown. As shown in FIG. 8, three taut armature reciprocating impulse transducers, 702, 704 and 706 are coupled to the soundboard 802 through a pedestal which comprises a platform 801 providing three separate platform sections 804, 806 and 808, each formed to provide mounting for one of the three taut armature reciprocating impulse transducer, 702, 704 and 706, respectively. The three platform sections 804, 806 and 808 are coupled to a foot 810, shown in FIG. 9, which couples the tactile energy generated by the three taut armature reciprocating impulse transducers, 702, 704 and 706 to the soundboard 802 so as to produce acoustic energy when the headphone is worn by the user. The three platform sections 804, 806 and 808 are spaced, by way of example, at 120° (360°/N where N is the number of non-linear impulse transducers supported by the platform) intervals relative to each other about an axis 814 which extends centrally through the foot 810 and the soundboard 802. The foot 810 is preferably formed contiguous with the platform 801 and the soundboard 802, and can be manufactured using conventional injection molding techniques and thermoset plastic materials. The foot 810 and three platform sections 804, 806 and 808 effectively mix bass, mid-range and treble responses produced by the three taut armature reciprocating impulse transducers, 702, 704 and 706; and since the foot 810 is substantially smaller in size than the soundboard 802, the stiffness of the soundboard 802 is minimized which results in maximizing the low frequency response capable of being produced by the soundboard 802, thereby enabling the soundboard 802 to more faithfully reproduce the bass, mid-range and treble responses of the three taut armature reciprocating impulse transducers, 702, 704 and 706. The mechanical acoustic crossover network 700 can be enclosed in a housing 812 to provide a headphone 800 which has provision, such as a head strap to couple the soundboard 802 to the user's ear. Head straps suitable for use with headphones are well known in the art. Two mechanical acoustic crossover networks can be attached to the head strap which would then provide a headphone set to provide stereophonic sound when the mechanical acoustic crossover networks coupled to a stereophonic audio source.

Figure 10:
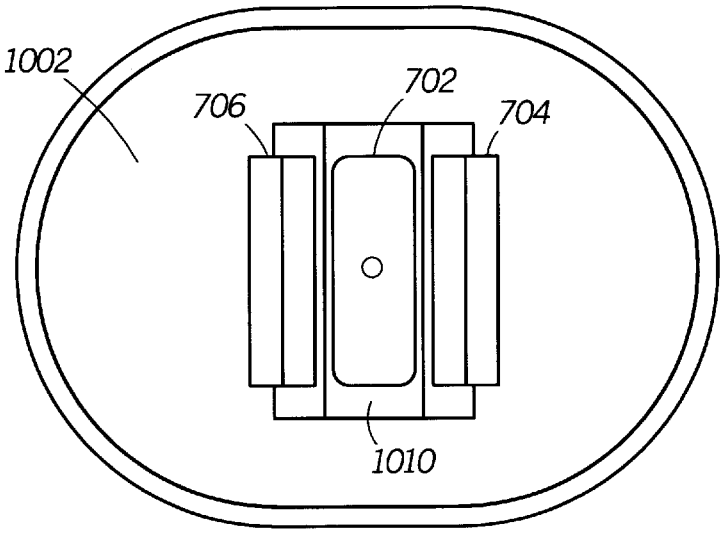
FIGS. 10 and 11 are orthographic views of the mechanical acoustic crossover network in accordance with a second embodiment of the present invention.
Figure 11:
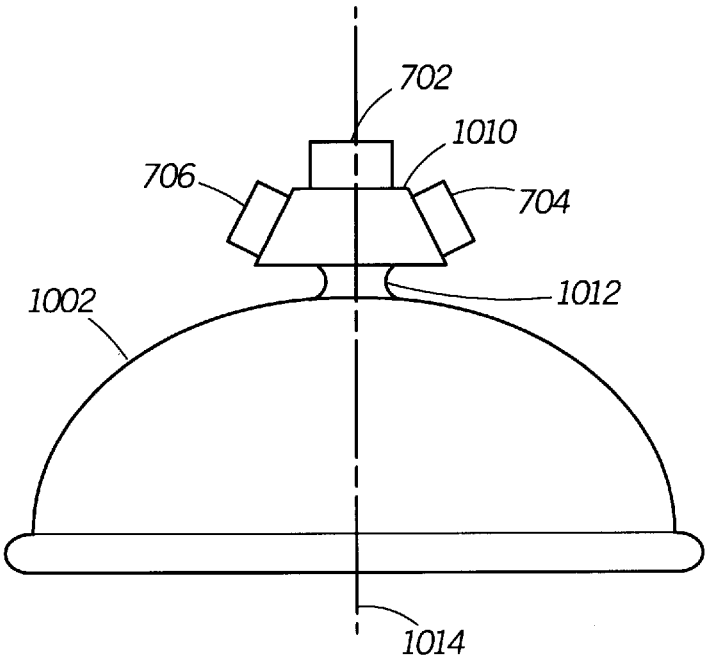

The mechanical acoustic crossover network in accordance with the present invention can also be implemented using rectangular taut armature reciprocating impulse transducers, such as described in U.S. Pat. No. 5,546,069 issued to Holden et al., entitled "Taut Armature Resonant Impulse Transducer", as shown in FIGS. 10 and 11. When rectangular taut armature reciprocating impulse transducers are utilized, at least one of the three transducers includes magnetic damping elements to produce a non-linear softening spring response. The mechanical acoustic crossover network 1000 includes a soundboard 1002 which can be formed as an ear cup of a headphone set, as shown. Three taut armature reciprocating impulse transducers, 702, 704 and 706 are coupled to the soundboard 1002 through a pedestal comprising a platform 1010 which is formed to provide mounting for the three taut armature reciprocating impulse transducer, 702, 704 and 706. The platform 1010 is coupled to a foot 1012, shown in FIG. 11 which couples the acoustic energy generated by the three taut armature reciprocating impulse transducers, 702, 704 and 706 to the soundboard 1002. The platform 1010 is attached to the soundboard 1002 about an axis 1014 which extends centrally through the foot 1012 and the soundboard 1002. The foot 1012 is preferably formed contiguous with the platform 1010 and the soundboard 1002, and can be manufactured using conventional injection molding techniques and thermoset plastic materials. As described above, the foot 1012 and platform 1010 effectively mix the bass, mid-range and treble responses of the three taut armature reciprocating impulse transducers, 704, 706 and 708; and since the foot 1012 is substantially smaller in size than the soundboard 1002, the stiffness of the soundboard 1002 is minimized which results in maximizing the low frequency response of the soundboard 1002, thereby enabling the soundboard 1002 to faithfully reproduce the bass, mid-range and treble responses of the three taut armature reciprocating impulse transducers, 702, 704 and 706. The position of the three taut armature reciprocating impulse transducers, 702, 704 and 706 on the platform 1010 can be interchanged.

It should be noted that the three taut armature reciprocating impulse transducers, 702, 704 and 706 used in the mechanical acoustic crossover network 700 and mechanical acoustic crossover network 1000 generate tactile energy over a very broad frequency range, the tactile energy being converted to acoustic energy within the soundboard. Because tactile energy is generated, the soundboard can be positioned directly against the mastoid process to produce sound by sensory stimulation using a "bone conduction" process.

In summary, a taut armature reciprocating impulse transducer has been described above which, while typically providing a non-linear hardening spring response, can be altered so as to provide a non-linear softening spring response. Two or more taut armature reciprocating impulse transducers can be utilized to produce a mechanical acoustic crossover network which operates in accordance with the present invention when at least one of the two taut armature reciprocating impulse transducers provides a non-linear softening spring response. The mechanical acoustic crossover network allows multiple taut armature reciprocating impulse transducers to be operated together from a signal input to provide a transducer having a very wide frequency response. When the mechanical acoustic crossover network is enclosed in a housing, the mechanical acoustic crossover network can be operated as a headphone to deliver an audio output, such as musical programming.

We claim:

1. A taut armature reciprocating impulse transducer, comprising:

an electromagnetic driver, for effecting an alternating electromagnetic field in response to an input signal;

an armature, including upper and lower substantially parallel planar suspension members, coupled to said electromagnetic driver, said upper and lower substantially parallel planar suspension members each comprising a plurality of independent planar non-linear spring members arranged regularly about a central planar region within a planar perimeter region;

a motional mass, supporting a plurality of permanent magnets arranged regularly about said motional mass, and suspended between said upper and lower substantially parallel planar suspension members about said central planar region, said permanent magnets being coupled to said alternating electromagnetic field for alternately moving said motional mass in response thereto; and a plurality of magnetic damping elements, connected to said planar perimeter region opposite said plurality of permanent magnets, wherein each magnetic damping element interacts with a permanent magnet to provide a non-linear, softening spring response.

2. The taut armature reciprocating impulse transducer of claim 1 further comprising a soundboard coupled to said electromagnetic driver for coupling acoustic energy to a user.

3. The taut armature reciprocating impulse transducer of claim 1, wherein each said plurality of independent planar non-linear spring members is defined by a pair of spring members having maximum opposing widths tapering to minimum opposing widths at midpoints thereon, said maximum opposing widths being coupled to said central planar region and to said planar perimeter region.

4. The taut armature reciprocating impulse transducer of claim 3, wherein said maximum opposing widths tapering to minimum widths at midpoints thereon are defined by spring members having an elliptical inner perimeter and a circular outer perimeter.

5. The taut armature reciprocating impulse transducer of claim 3, wherein said planar non-linear spring members produce a non-linear, hardening spring response.

6. The taut armature reciprocating impulse transducer of claim 1, wherein each of said plurality of independent planar non-linear spring members comprise a pair of juxtaposed planar compound beams.

7. The taut armature reciprocating impulse transducer of claim 6, wherein said pair of juxtaposed planar compound beams produce a non-linear, hardening spring response.

8. A mechanical acoustic crossover network, comprising:

a first and at least second non-linear impulse transducer, each sharing a signal input, wherein at least one non-linear impulse transducer of said first and at least second non-linear impulse transducers provides a non-linear softening spring response;

a soundboard; and a pedestal, comprising a platform formed to mount said first and at least second non-linear impulse transducers, and a foot, coupled to said platform and to said soundboard, said foot coupling tactile energy generated by said first and at least second non-linear impulse transducers to said soundboard to produce acoustic energy.

9. The mechanical acoustic crossover network according to claim 8, wherein said at least one non-linear impulse transducer which provides the non-linear softening spring response produces a low frequency response when said signal input is coupled to an audio signal.

10. The mechanical acoustic crossover network according to claim 8, wherein said first and at least second non-linear impulse transducers comprise:

an electromagnetic driver, for effecting an alternating electromagnetic field in response to an input signal;

an armature, including upper and lower substantially parallel planar suspension members, coupled to said electromagnetic driver, said upper and lower substantially parallel planar suspension members each comprising a plurality of independent planar non-linear spring members arranged regularly about a central planar region within a planar perimeter region; and a motional mass, supporting a plurality of permanent magnets arranged regularly about said motional mass, and suspended between said upper and lower substantially parallel planar suspension members about said central planar region, said plurality of permanent magnets being coupled to said alternating electromagnetic field for alternately moving said motional mass in response thereto.

11. The mechanical acoustic crossover network according to claim 10, wherein at least one of said first and second non-linear impulse transducers further includes a plurality of magnetic damping elements which couple to said plurality of permanent magnets to provide a non-linear softening spring response.

12. The mechanical acoustic crossover network of claim 10, wherein each said plurality of independent planar non-linear spring members are defined by a pair of spring members having maximum opposing widths tapering to minimum opposing widths at midpoints thereon, said maximum opposing widths being coupled to said central planar region and to said planar perimeter region.

13. The mechanical acoustic crossover network of claim 12, wherein said maximum opposing widths tapering to minimum widths at midpoints thereon are defined by spring members having an elliptical inner perimeter and a circular outer perimeter.

14. The mechanical acoustic crossover network of claim 12, wherein said planar non-linear spring members produce a non-linear, hardening spring response.

15. The mechanical acoustic crossover network of claim 10, wherein each of said plurality of independent planar non-linear spring members comprise a pair of juxtaposed planar compound beams.

16. The mechanical acoustic crossover network of claim 15, wherein said pair of juxtaposed planar compound beams produce a non-linear, hardening spring response.

17. The mechanical acoustic crossover network of claim 8, wherein said platform comprises a first platform section to mount said first non-linear impulse transducer and at least a second platform section to mount said at least second non-linear impulse transducer.

18. The mechanical acoustic crossover network of claim 17, wherein said platform sections are positioned 360°/N with respect to each other, where N is the number of non-linear impulse transducers supported by said platform.

19. A headphone, comprising:

a mechanical acoustic crossover network, comprising a first and at least second non-linear impulse transducer, each sharing a signal input, wherein at least one non-linear impulse transducer of said first and at least second non-linear impulse transducers provides a non-linear softening spring response, a soundboard, and a pedestal, comprising a platform formed to mount said first and at least second non-linear impulse transducers, and a foot, coupled to said platform and to said soundboard, said foot coupling tactile energy generated by said first and at least second non-linear impulse transducers to said soundboard to produce acoustic energy; and a housing for enclosing said mechanical acoustic crossover network, said housing having provision to couple said soundboard to a user's ear.

20. The headphone according to claim 19 further comprising a second mechanical acoustic crossover network which is enclosed in a housing which has provision for also being worn by the user, wherein said first and second mechanical acoustic crossover networks provide stereophonic sound when coupled to a stereophonic audio source.

21. The headphone according to claim 19 wherein said soundboard can be positioned against the mastoid process to produce sound by sensory stimulation using a bone conduction process.

* * * * *

UNITED STATES PATENT AND TRADEMARK OFFICE

CERTIFICATE OF CORRECTION

PATENT NO. : 6,067,364

DATED : May 23, 2000

INVENTOR(S) : Brinkley, et al.

It is certified that error appears in the above-indentified patent and that said Letters Patent is hereby corrected as shown below: Title page, item [75]

Insert the third-named inventor:

Philip P.Macnak, West Palm Beach, Florida

Signed and Sealed this

Twenty-second Day of May, 2001

*Attest:*

Nicholas P. Godici

NICHOLAS P. GODICI

*Attesting Officer*

*Acting Director of the United States Patent and Trademark Office*